US005643487A

United States Patent [19]

Malone

[11] Patent Number: 5,643,487

[45] Date of Patent: Jul. 1, 1997

[54] BEAM AND PROP SYSTEM FOR SUPPORTING CONCRETE FORMWORK

[76] Inventor: William J. Malone, 6 Tortoise Court, Brampton, Ontario, Canada, L6T 3Z8

[21] Appl. No.: 436,762

[22] Filed: May 8, 1995

[51] Int. Cl.[6] ..... E04G 11/38

[52] U.S. Cl. ..... 249/18; 249/23; 249/25; 249/28; 249/30; 249/210; 249/211

[58] Field of Search ..... 249/18, 23, 25, 249/28, 30, 210, 211

[56] References Cited

U.S. PATENT DOCUMENTS

| | | | |
|---|---|---|---|
| 3,397,858 | 8/1968 | Williams | 249/18 |
| 3,430,910 | 3/1969 | Bowden et al. | 249/210 |
| 3,614,048 | 10/1971 | Young | 249/210 |
| 3,647,173 | 3/1972 | Pipala | 249/18 |
| 3,977,646 | 8/1976 | Moon et al. | 249/50 |
| 4,880,203 | 11/1989 | Holcomb et al. | 249/25 |

FOREIGN PATENT DOCUMENTS

| | | | |
|---|---|---|---|
| 4237516 | 5/1994 | Germany | 249/28 |

*Primary Examiner*—Thomas R. Weber
*Attorney, Agent, or Firm*—Mirek A. Waraksa

[57] ABSTRACT

A formwork frame for supporting decking and a fresh concrete floor on the decking includes a horizontal beam whose upper surface contacts the concrete and a vertical shaft that supports the beam. The beam is formed in three separable extruded aluminium sections, a central section mounted on the shaft and a pair of outer sections. The central beam section has opposing ends mitred to converge in a downward direction, and each outer beam has an end mitered to meet one end of the central beam section. The beam has a horizontal channel in each of its sides, and a pair of horizontal ledges close the channels from below. A pair of extruded aluminum bridging members fit closely into the channels and are effectively reinforced by the beam sections to resist bending moments. Pins extend horizontally through the bridging members and the outer beam sections to secure the bridging members to the beam. The pins are not subjected shear forces or bending moments.

4 Claims, 2 Drawing Sheets

BEAM AND PROP SYSTEM FOR SUPPORTING CONCRETE FORMWORK

FIELD OF THE INVENTION

The invention relates to formwork for forming a concrete floor, and more specifically, to a support structure that permits decking supporting the concrete floor to be removed without disengaging a vertical prop from the concrete floor.

DESCRIPTION OF THE PRIOR ART

Formwork for a concrete floor has traditionally consisted of decking formed in sections such as panels or beams, a rectangular frame that supports the periphery of the decking, and a beam that extends horizontally between opposite sides of the frame to support central parts of the decking. The rectangular frame is normally supported around its perimeter with vertical beams or panels. A vertical prop normally supports the beam and reacts much of the weight at the center of the new floor. To disassemble the formwork, the prop must be removed first to free the beam and the decking. Normally this cannot be done until the concrete floor is substantially fully set since central support for the concrete floor otherwise remains critical. If the formwork were removable without disengaging the prop from the fresh concrete floor, the frame, decking and various vertical supports could actually be used elsewhere on a construction site several days earlier, reducing equipment requirements and cost.

Various formwork systems have been proposed that allow a central prop to remain in continual contact with a fresh concrete floor while the rest of the formwork is removed. Such systems have generally involved complex mechanisms that allow sections of the beam to be separated and lowered relative to the head of the prop. It would be preferable to provide a simple and robust support for such applications.

SUMMARY OF THE INVENTION

In one aspect, the invention provides a central support structure for a formwork frame adapted to support decking and a fresh concrete floor placed on the decking. The support structure comprises an elongate horizontal beam with an upper surface intended to contact the concrete floor and a pair of opposing sides. The beam has a pair of horizontal channels recessed into different sides of the beam, and a pair of horizontal ledges extending laterally outward from different sides of the beam to close the channels from below. The beam is formed in separable sections which include a central beam section supported with a vertical shaft and a pair of outer beam sections. The central beam section has axially opposing end surfaces that converge downward toward one another. Each outer beam section has an end which is normally supported by the formwork frame, and an opposing end surface which intersects the channels and ledges and which inclines down and below the central beam section so that each outer beam section can be separated in a downward direction from the central beam section. A pair of rigid bridging members are fitted into the two channels, and means are provided to releasably secure the bridging members in their respective channels. The securing means are preferably pins extending through horizontally aligned passages in the bridging members and the outer beams sections. Each bridging member extends from one outer beam section to the other outer beam section so that the bridging members support the outer beam sections from the central beam section.

The central beam section and shaft constitute a prop that provides continual support to the fresh concrete floor. The outer beam sections and decking can be removed by releasing the bridging members. Major advantages of the arrangement reside in the manner in which the weight of the concrete floor is reacted and in the simplicity of construction and use. More specifically, the securing means need resist only lateral displacement of the bridging members not significant bending moments or vertical shear forces created by the concrete floor. Such moments and shear forces are reacted through the bridging members directly into the beam sections. Since the bridging members are confined within the channels, the beams sections effectively reinforce the bridging members against bending.

Various aspects of the invention will be more apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 4:
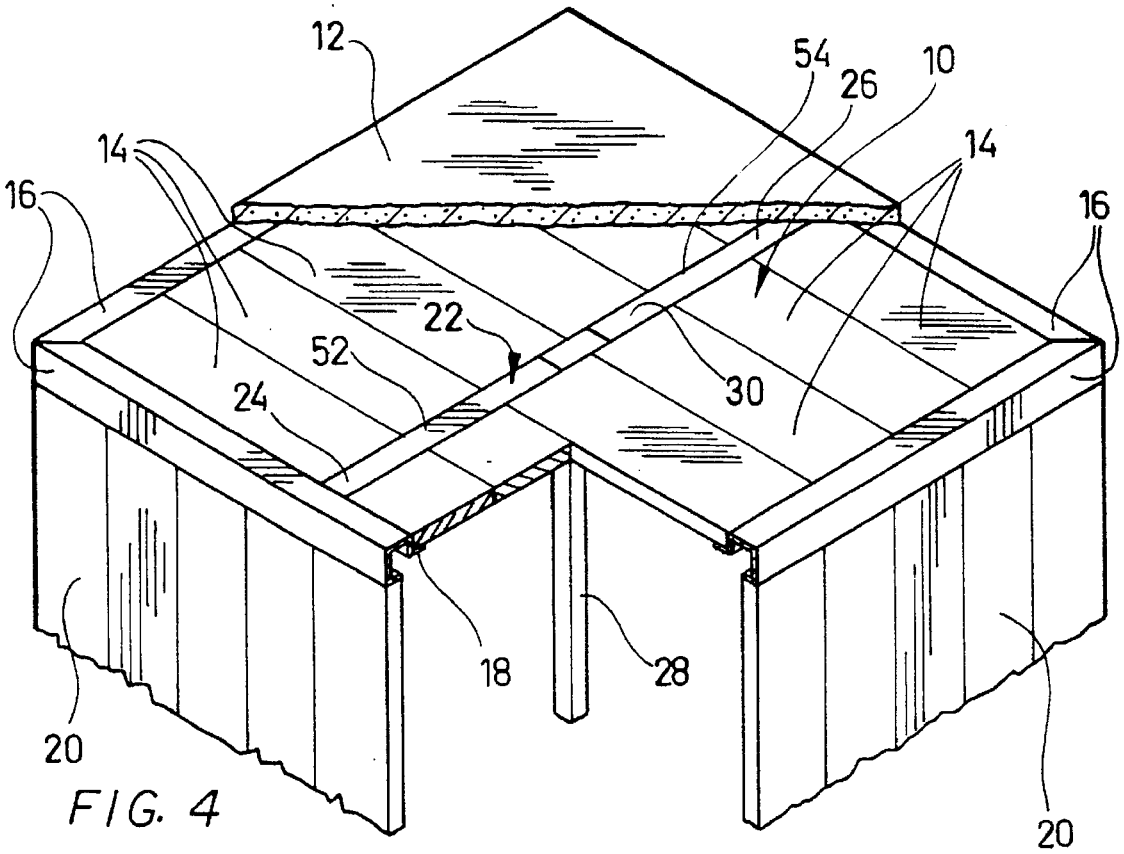
FIG. 4 is a fragmented orthogonal view showing a formwork frame supporting decking and a concrete floor placed on the decking; and, FIG. 5 is an elevational view showing how the outer beam sections can be removed while the central beam section and prop continue to support the concrete floor.

Reference is made to FIG. 4 which shows a formwork frame supporting decking 10 over which a concrete floor 12 is poured. The decking 10 may consist of aluminum panels 14 whose butted side edges are releasably pinned together in a conventional manner. The formwork frame includes a rectangular frame 16 formed of mitred aluminum extrusions. The extrusions together define a circumferential ledge 18 within the rectangular frame 16 that supports the periphery of the decking 10, keeping the decking 10 substantially flush with the top of the rectangular frame 16. The rectangular frame 16 is itself supported on vertical formwork panels 20. The decking 10 is centrally supported by a horizontal beam 22 whose axially opposing ends 24, 26 seat on the circumferential ledge 18 of the rectangular frame 16 and whose center is supported by an elongate vertical shaft 28 from subjacent flooring (not shown).

Figure 1:
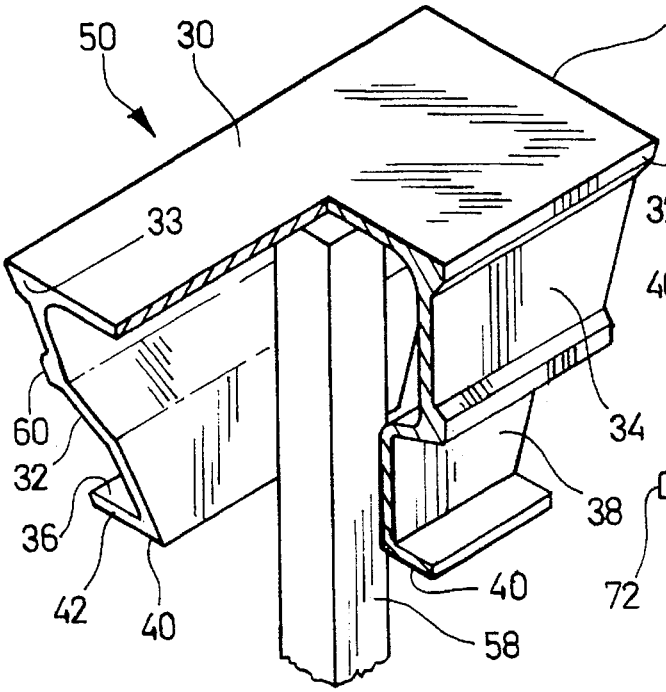
FIG. 1 is a partially-sectioned perspective view of a central beam section adapted for mounting on a prop.
Figure 2:
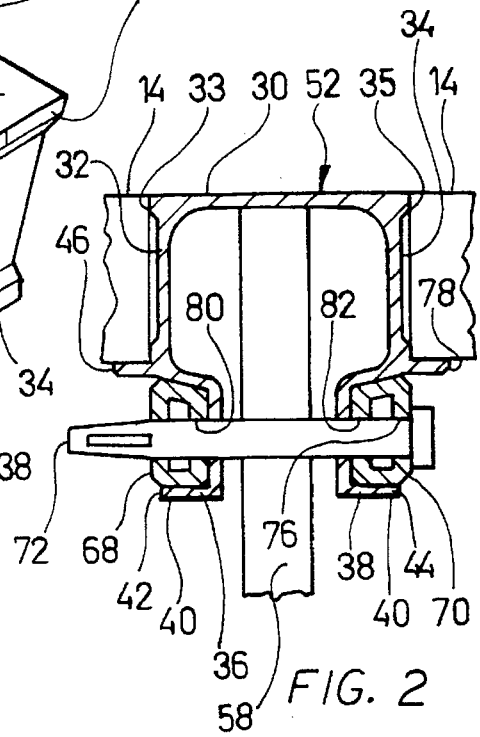
FIG. 2 is a fragmented perspective view showing an entire beam and prop supporting deck panels centrally in decking.
Figure 3:
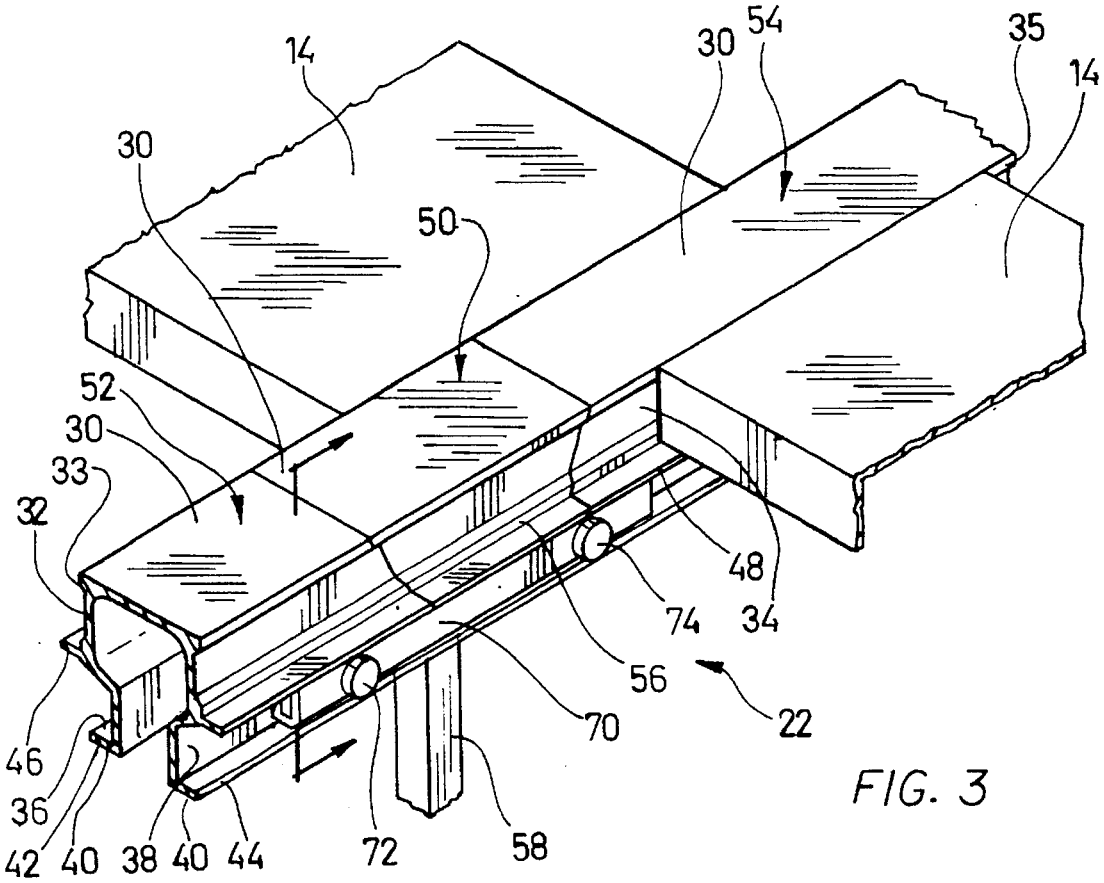
FIG. 3 is a view along the lines 3—3 of FIG. 2 detailing the transverse cross-sections of an outer beam section and a pair of bridging members and showing how the bridging members are secured to the beam.

The construction of the beam 22 is more apparent in FIG. 2 and 3. The top 30 of the beam 22 is a planar horizontal surface that contacts the concrete floor 12. The beam 22 has a pair of opposing sides 32, 34 that extend downwardly from lateral edges 33, 35 of the top 30. A pair of horizontal channels 36, 38 are recessed into the sides 32, 34 of the beam 22, proximate to the bottom 40 of the beam 22, and a lower pair of horizontal ledges 42, 44 that extend laterally outward from the sides 32, 34 close the channels 36, 38 from below. The beam 22 also has a pair of upper ledges 46, 48 each extending laterally outward from a different side 32, 34 of the beam 22 and each positioned vertically between one of the channels 36, 38 and the top 30 of the beam 22. The upper ledges 46, 48 support deck panels 14 flush with the top 30 of the beam 22 as apparent in FIGS. 2 and 3.

The beam 22 is formed in three separable sections. A central beam section 50 effectively serves as a prop head. A pair of outer beam sections 52, 54 extend in different axial directions from the central beam section 50. The outer beam sections 52, 54 are identical aluminum extrusions, each defining part of the top 30, bottom 40, sides 32, 34, channels 36, 38, and upper 46, 48 and lower 42, 44 ledges of the beam 22, as apparent from the cross-sectional view of FIG. 3. The central beam section 50 is an aluminum extrusion whose outer transverse profile corresponds to the outer transverse profile of the outer beam sections 52, 54 so that the top 30, sides 32, 34, channels 36, 38 and lower ledges 42, 44 are substantially continuous along the three beam sections 50, 52, 54. Each of the upper ledges 46, 48 has a gap between horizontally aligned sections of the upper ledges 46, 48 (such as the gap indicated at 56 in FIG. 2) which spans the central beam section 50. Deck panels 14 might typically span the gaps in the upper ledges 46, 48, resting on the outer beam sections 52, 54. This arrangement ensures that deck panels 14 at the central beam section 50 can be removed when the outer beam sections 52, 54 are separated from the central beam section 50.

The central beam section 50 together with the shaft 28 functions as a central prop, the central beam section 50 serving as a prop head. The central beam section 50 has a hollow rectangular tube 58 extruded of aluminum. The upper end of the tube 58 is welded to the top of the central beam section 50, and the tube 58 extends downward between the opposing lower ledges 42, 44. The shaft 28 is extruded of aluminum with a complementary cross-section that closely receives the tube 58 and butts against the bottoms of the lower ledges 42, 44 (the butting not being illustrated). The shaft 28 will typically be cut to a length appropriate for particular spacing between floors.

Figure 5:
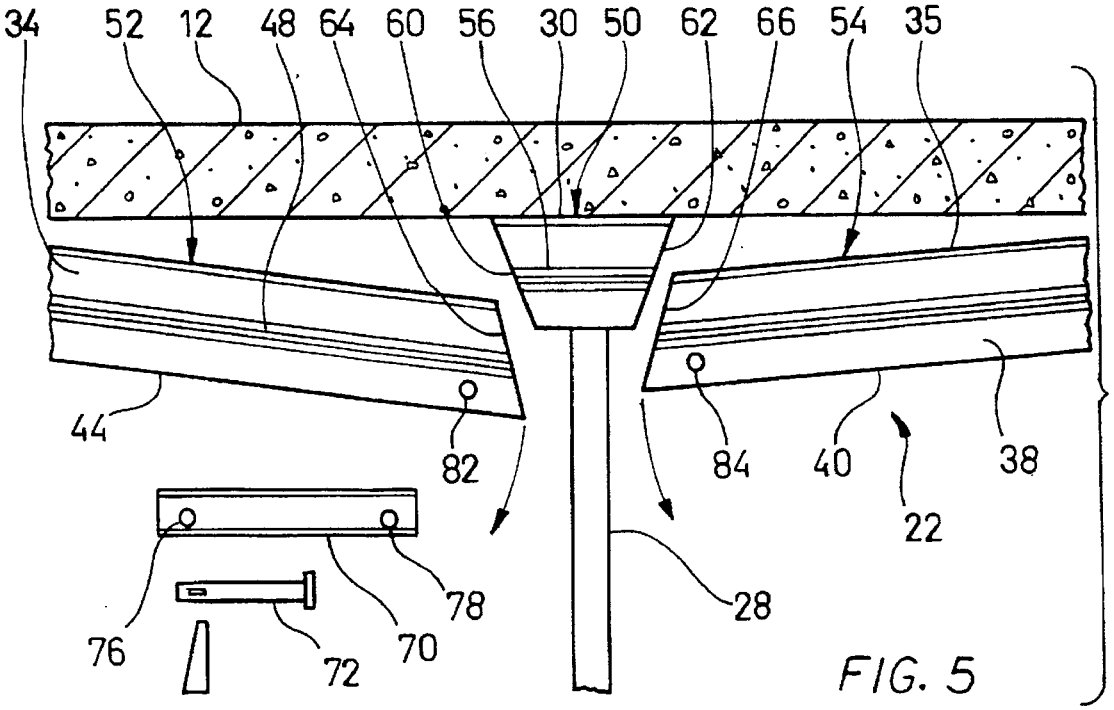

The shape of the ends 42, 26 of beam sections 52, 54 is more apparent in FIG. 4 and 5. The central beam section 50 has a pair of axially opposing planar end surfaces 60, 62 mitred to incline and converge downward. The outer beam sections 52, 54 have end surfaces 64, 66 appropriately mitred to meet the ends surfaces 60, 62 of the central beam section 50. Each of the end surfaces 64, 66 of the outer beam sections 52, 54 inclines downward and under the central beam section 50, effectively permitting the outer beam sections 52, 54 to be displaced downward relative to the central beam section 50 without obstruction, as shown in FIG. 5. The end surfaces 64, 66 of the beam sections 52, 54 intersect the channels 36, 38 and ledges 42, 44, 46, 48 of the beam 22 intermediate their axial ends 24, 26. The shape of the opposing ends 24, 26 of the beam sections 52, 54 is not critical since they must simply seat on the circumferential ledge 18 of the rectangular frame 16.

A pair of bridging members 68, 70 are used to join the outer beam sections 52, 54 and support them from the central beam section 50. The bridging members 68, 70 are identical hollow aluminum extrusions shaped to fit tightly into the channels 36, 38, as most apparent in FIG. 3. As apparent in FIG. 2, the bridging member 70 spans the junctions between the beam sections 52, 54, extending within its channel 38 from one outer beam section 52 to the other outer beam section 54. The other bridging member 68 spans the central beam section 50 in a similar manner, extending between the two outer beam sections 52, 54.

The bridging members 68, 70 are releasably secured in their respective channels 36, 38 by a pair of wedge pins 72, 74. The bridging member 70 which is typical has a pair of horizontal passages 76, 78 (both shown in FIG. 5) which are adjacent different ends of the bridging member 70. One such passage 80 of the other bridging member 68 is apparent in FIG. 3 where pinning of the two bridging members 68, 70 to the leftmost outer beam section 52 is detailed. The leftmost outer beam section 52 has a horizontal passage 82 extending fully between the channels 36, 38 of the beam 22. Passages 80, 76 in the two bridging members 68, 70 are horizontally aligned with the passage 82 of the leftmost outer beam section 52, and the leftmost wedge pin 72 is inserted through the three aligned passages 80, 82, 76 and secured with a wedge. The rightmost beam section 54 has a similar horizontal passage 84 (shown in FIG. 5) through which the rightmost wedge pin 74 is inserted to secure the other ends of the bridging members 68, 70 in a comparable joint.

How the support structure constituted by the beam 22 and shaft 28 is used will be briefly described. The rectangular frame 16 and vertical supporting panels 20 are assembled as shown in FIG. 4. The central beam section 50 is mounted with its vertical tube 58 onto the shaft 28. The outer beam sections 52, 54 may then be aligned with the central beam section 50 on the subjacent flooring. The bridging members 68, 70 are inserted into their respective channels 36, 38, and the wedge pins 72, 74 are installed to secure the bridging members 68, 70. The resulting support structure is then positioned as shown in FIG. 4 with outer ends 24, 26 of the outer beam sections 52, 54 supported on the circumferential ledge 18 of the rectangular frame 16, and the shaft 28 supporting the beam 22 from the subjacent flooring (not shown). The decking 10 may then be installed on the circumferential ledge 18 defined by the rectangular frame 16 and the upper ledges 46, 48 of the beam 22, and the adjacent panels 14 may be pinned together.

A concrete floor 12 may then be placed on the decking 10 as shown in FIG. 4. The concrete floor 12 is allowed to set until the prop itself is sufficient to support the floor against collapse. The pins are then be removed, and the bridging members 68, 70 are removed from their channels 36, 38. The mitred ends of the two beam sections 52, 54 are simply displaced downwardly as shown in FIG. 5. The deck panels 14 are then be disconnected from one another and removed. The rectangular frame 16 and vertical panels 20 are then removed. A spare central beam section 50 and another shaft can then be used to erect the formwork at another location.

The advantages of the invention have been summarized above. However, they may be more apparent with reference to FIGS. 2 and 3. The transverse profiles of the bridging members 68, 70 conform to and mate with the profiles of their respective channels 36, 38 so that upper and lower surfaces of the bridging members 68, 70 are fully contacted from above and below by the beam sections 50, 52, 54. The beam sections 50, 52, 54 thus reinforce the bridging members 68, 70 against bending. The pins used to secure the bridging members 68, 70 are not subject to significant shear force.

It will be appreciated that a particular embodiment of the invention has been described and that modifications may be made therein without necessarily departing from the scope of the appended claims. In that regard, it should be noted that the upper panel-supporting ledges 46, 48 are strongly preferred but not strictly necessary. The aluminum decking panels 14 can be pinned to the sides 32, 34 of the beam 22.

I claim:

1. In a formwork frame for supporting decking and a fresh concrete floor placed on the decking, a support structure comprising:

an elongate horizontal beam, the beam comprising a horizontal top for supporting the concrete floor, a bottom, a pair of opposing sides each extending downwardly from a different lateral edge of the top, a pair of horizontal channels each recessed into a different one of the sides of the beam proximate to the bottom of the beam, and a pair of horizontal ledges each extending laterally outward from a different one of the sides and closing a different one of the channels from below, the beam comprising a central beam section and a pair of outer beam sections axially aligned with the central beam section, the central beam section located between the outer beams sections, the central beam section comprising a pair of axially opposing end surfaces which converge downward toward one another, each of the outer beam sections comprising an end surface inclined downward and axially below the central beam section such that each of the outer beam sections can be separated in a downward direction from the central beam section;

a vertical shaft for supporting the central beam section from a surface below the concrete floor;

a pair of rigid bridging members, each of the bridging members being fitted into in a different one of the channels, each of the bridging members extending from one of the outer beam sections to the other of the beam sections whereby each of the bridging members supports the pair of outer beams sections from the central beam section; and, releasable securing means for securing the bridging members to the channels in which the bridging members are fitted, whereby, upon releasing the securing means, the outer beam sections can be separated downward from the central beam section while leaving the central beam section and the vertical shaft supporting the concrete floor.

2. The formwork frame of claim 1 in which the securing means comprising a pair of passages in the beam, each of the passages extending horizontally between the channels of the beam and located in a different one of the outer beam sections;

a pair of passages in each of the bridging members, each of the pair of passages in each of the bridging members being horizontally aligned with a different one of the passages in the beam; and, a pair of fasteners, each of the fasteners extending through a different one of the passages of the beam and the passages of the bridging members that are aligned with the passage of the beam.

3. The formwork frame of claim 1 in which:

the beam comprising a pair of horizontal deck-supporting ledges;

each of the deck-supporting ledges extends laterally outward from a different side of the beam between the top of the beam and the channel recessed in the side of the beam from which the deck-supporting ledge extends; and, each of the deck-supporting ledges has a gap spanning the central beam section.

4. The formwork frame of claim 1 in which:

the outer beam sections are identical hollow aluminum extrusions;

the central beam sections is a hollow aluminum extrusion whose transverse outer profile corresponds to the transverse outer profile of the outer beam sections to define the pair of channels and the pair of ledges; and, the pair of bridging members are aluminum extrusions each of which conforms to the channel in which the bridging member is fitted.

* * * * *